US005709618A

United States Patent [19]

Hwang

[11] Patent Number: 5,709,618

[45] Date of Patent: Jan. 20, 1998

[54] GOLF BALL

[75] Inventor: In Hong Hwang, Seoul, Rep. of Korea

[73] Assignee: Ilya Co. Ltd., Seoul, Rep. of Korea

[21] Appl. No.: 807,174

[22] Filed: Feb. 27, 1997

[30] Foreign Application Priority Data

Apr. 12, 1996 [KR] Rep. of Korea ..... 96-10980

[51] Int. Cl.[6] ..... A63B 37/14

[52] U.S. Cl. ..... 473/382; 473/384; 473/378

[58] Field of Search ..... 473/382, 383, 473/384, 378

[56] References Cited

U.S. PATENT DOCUMENTS

| | | | |
|---|---|---|---|
| 4,844,472 | 7/1989 | Ihara | 473/379 |
| 4,867,459 | 9/1989 | Ihara | 473/379 |
| 5,332,226 | 7/1994 | Kim | 473/384 |

*Primary Examiner*—George J. Marlo
*Attorney, Agent, or Firm*—Amster, Rothstein & Ebenstein

[57] ABSTRACT

The present invention refers to an arrangement of dimples on a golf ball which has a plurality of dimples on its spherical surface, The arrangement of dimples is made by dividing sphere's surface of a golf ball by great circles to form an octahedron, making the center of a spherical triangle in the said octahedron as a pole, and dividing again the said sphere's surface by great circles to form a new octahedron at the position turning on the said pole as a center in an angle of 60 degrees, and dividing again the said sphere's surface by great circles made by extending the lines connecting the adjacent midpoints of the sides of spherical triangle with a pole to one another, and dividing again the said sphere's surface by great circles made by extending the lines connecting the adjacent midpoints of the sides of spherical triangle at the position turning on the said pole as a center in an angle of 60 degrees to one another, and arranging dimples in the spherical polygons formed in dividing the said sphere's surface by great circles made by extending the lines connecting the midpoints of apices on spherical triangle with a pole as a center and the apices of spherical triangle at the position turning in an angle of 60 degrees to the pole. The aforementioned spherical polygons are composed of 2 spherical hexagons, 12 spherical pentagons, 12 spherical rhombuses and 12 spherical triangles.

11 Claims, 8 Drawing Sheets

GOLF BALL

TECHNICAL FIELD

This invention relates to a golf ball. More particularly, the present invention embodies a golf ball having a dimple arrangement which both northern hemisphere and southern hemisphere are arranged in symmetry vertical to the line of equator, thereby improving the golf ball's flight distance while maintaining its aerodynamic stability as compared with that of dimples on the existing common golf balls which dimples are symmetrically arranged on the equator line in sloping by some 30° or 45°.

BACKGROUND OF THE INVENTION

The arrangement of dimples on other common golf balls that dimples are symmetrically arranged on the equator line in sloping by some 30° or 45° was effective in improving the carry extended. However, the studies for the arrangement of dimples on golf ball in the industry concerned, today, are beginning to focus on an arrangement of dimples on golf ball to improve the aerodynamic stability and realize the carry much further extended. Thus, the purpose of this invention is to improve the aerodynamic stability and extend the carry by using the much better dimple arrangement of golf ball than that of the existing common golf balls.

SUMMARY OF THE INVENTION

The arrangement of dimples on golf ball according to the present invention is made by dividing sphere's surface of a golf ball by great circles to form an octahedron, making the center of a spherical triangle in the said octahedron as a pole, and dividing again the said sphere's surface by great circles to form a new octahedron at the position turning on the said pole as a center in an angle of 60 degrees, and dividing again the said sphere's surface by great circles made by extending the lines connecting the adjacent midpoints of the sides of spherical triangle with a pole to one another, and dividing again the said sphere's surface by great circles made by extending the lines connecting the adjacent midpoints of the sides of spherical triangle at the position turning on the said pole as a center in an angle of 60 degree to one another, and arranging dimples if the spherical polygons formed in dividing the said sphere's surface by great circles made by extending the lines connecting the midpoints of apices on spherical triangle with a pole as a center and the apices of spherical triangle at the position turning in an angle of 60 degrees to the pole. Upon the composition in dividing the sphere's surface of golf ball according to the present invention, the aforementioned spherical polygons are composed of 2 spherical hexagons, 12 spherical pentagons, 12 spherical rhombuses and 12 spherical triangles.

Additionally, upon the composition in dividing the sphere's surface of golf ball according to the present invention, the identical spherical polygons of which each hemisphere is vertical to the line of equator are in symmetry with the equator as a center by themselves.

BRIEF DESCRIPTION OF THE DRAWINGS

The invention will be explained in conjunction with an illustrative embodiment shown in the accompanying drawing, in which.

DETAILED DESCRIPTION OF THE PREFERRED EMBODIMENT

Figure 1:
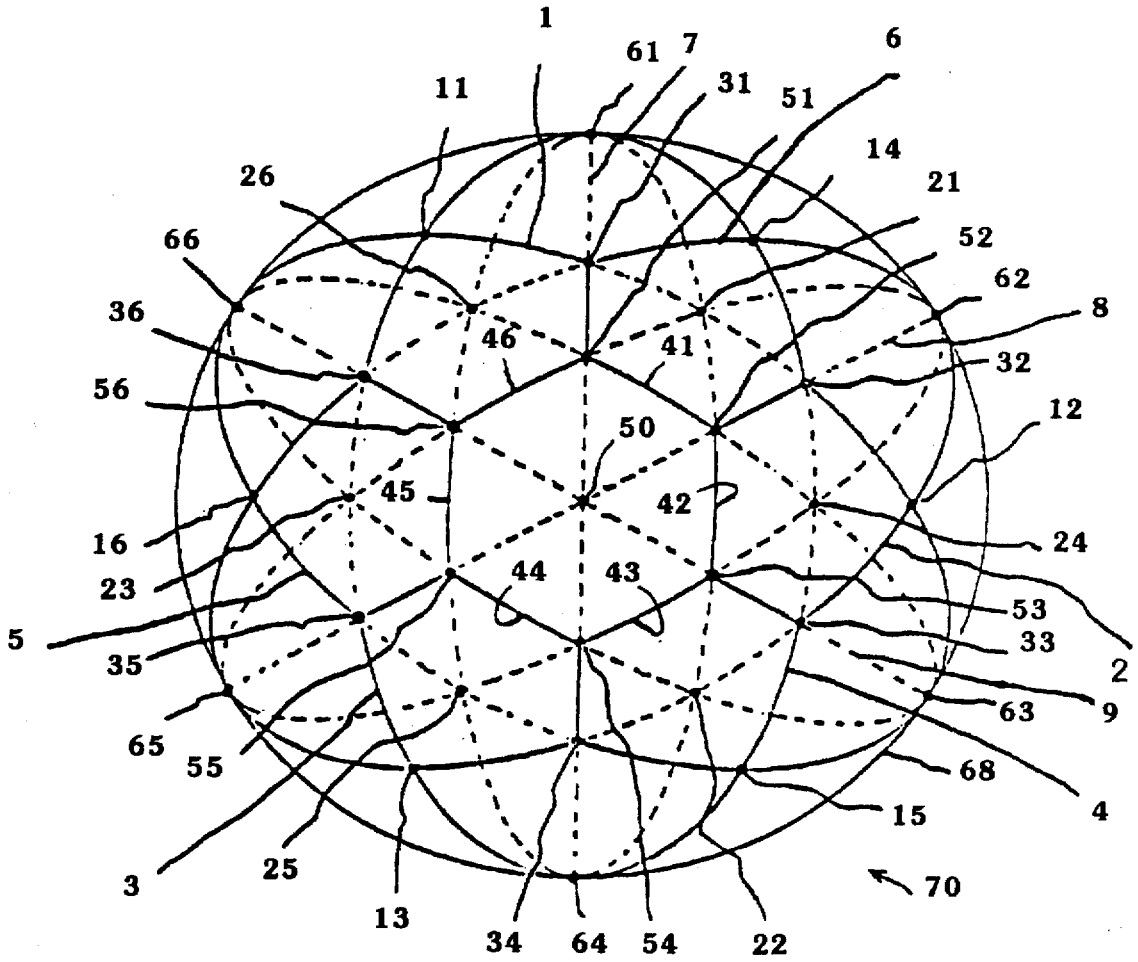
FIG. 1 is a polar view of the surface of golf ball according to the present invention and illustrates the spherical polygons made by dividing the said sphere's surface by the aforementioned method.
Figure 2:
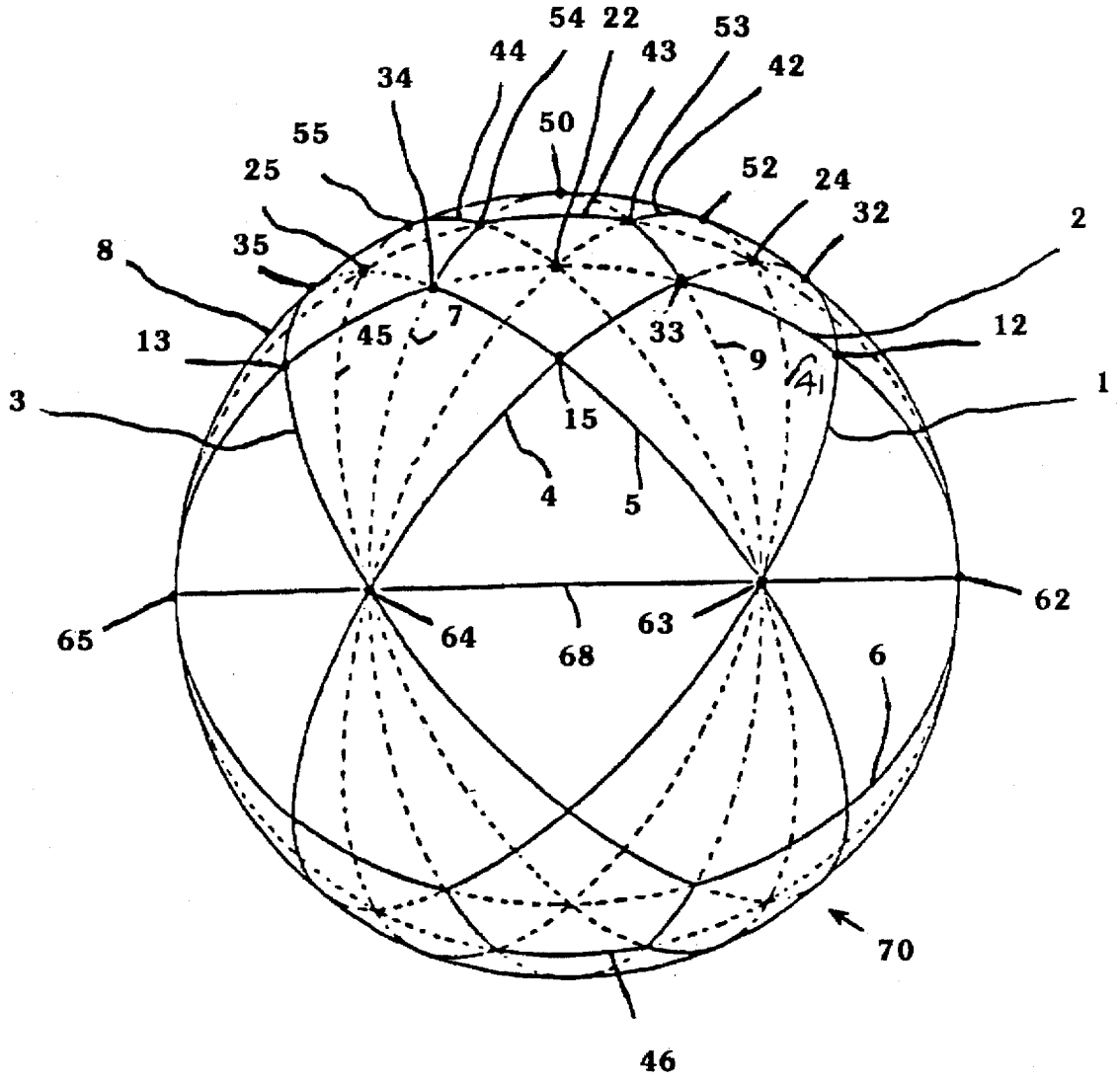
FIG. 2 is an equatorial view of the surface of golf ball according to the present invention, which is applying the same divisional composition as shown in FIG. 1 about the southern hemisphere and the northern hemisphere in vertical symmetry to the line of equator.
Figure 3:
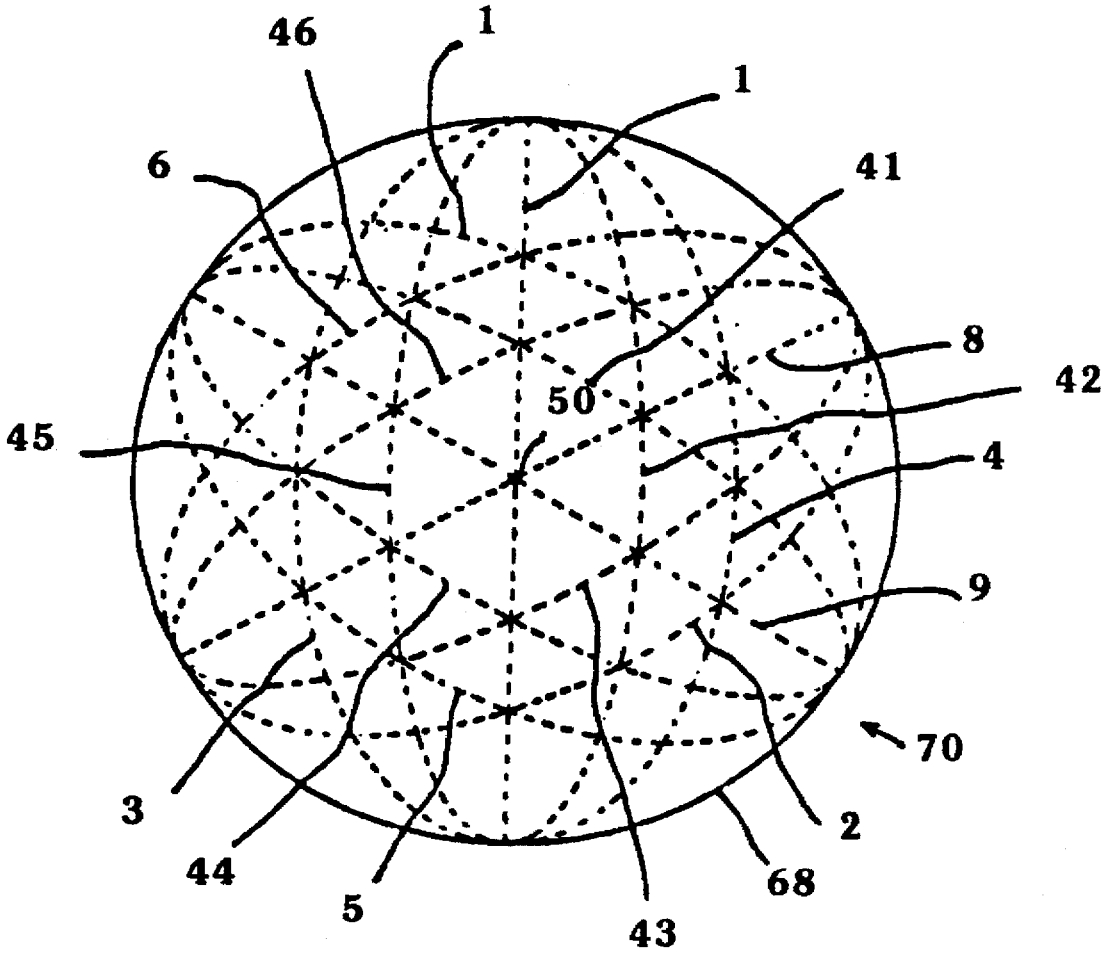
FIG. 3 is a polar view of the surface of golf ball according to the present invention, showing each great circle made by dividing the said sphere's surface as illustrated in FIG. 1 on a pole in order to form the spherical polygons as shown in FIG. 1.
Figure 4:
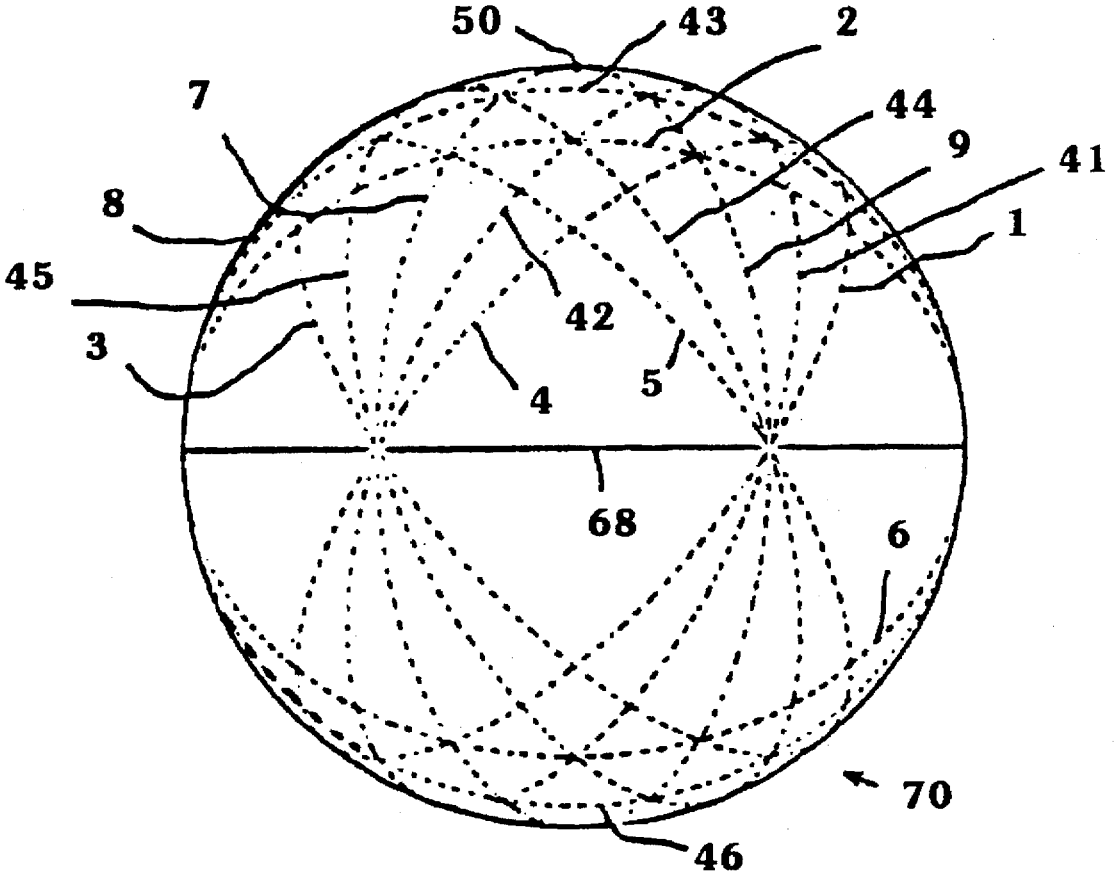
FIG. 4 is an equatorial view of the surface of golf ball in the same divisional composition as illustrated in FIG. 3.

The present invention relates to a golf ball having a dimple configuration associated with its outer spherical surface that improves the golf ball's flight distance while maintaining its aerodynamic stability. In particular, the present invention incorporates a dimple configuration with dimples of various sizes that are uniformly distributed symmetrically about the equator towards each of the two poles. This invention will be described in connection with the drawings. Referring to FIG. 3 and FIG. 4, the first thing to be done is to divide sphere's surface of golf ball by lines(1, 2, 3) into an octahedron, make the center of a spherical triangle which composed the said octahedron as a pole(50), and divide again the said sphere's surface by lines(4, 5, 6) to form a new octahedron at the position turning on the said pole as a center in an angle of 60 degrees. And, the said sphere's surface is divided once again by lines(42, 44, 46) made by extending the lines connecting the adjacent midpoints of the sides of spherical triangle with a pole as a center in the octahedron made by lines(1, 2, 3) to one another. And the said sphere's surface is further divided again by lines(41, 43, 45) made by extending the lines connecting the adjacent midpoints of the sides of spherical triangle at the position turning on the said pole as a center in an angle of 60 degrees in the octahedron made by lines(4, 5, 6) to one another. Additionally, the said sphere's surface is divided again by lines(7, 8, 9) made by extending the lines connecting the midpoints of apices of the spherical triangle at the position turning on the said pole as a center in an angle of 60 degree made by lines (4, 5, 6) and the apices of spherical triangle made by lines (1, 2, 3) with a pole as a center to a pole(50).

All the above mentioned lines(1, 2, 3, 4, 5, 6, 7, 8, 9, 41, 42, 43, 44, 45, 46) are great circles.

Dimples can be arranged by dividing again the said sphere's surface by spherical polygons composed of the points that each great circle intersects on the surface of sphere which is composed of these great circles, that is, point(12) at which line(1) and line(2) intersect, point(11) at which line(1) and line(3) intersect, point(13) at which line(2) and line(3) intersect, point(14) at which line(4) and line(6) intersect, point(15) at which line(4) and line(5) intersect, point(16) at which line(5) and line(6) intersect, point(31) at which line(1) and line(6) intersect, point(32) at which line(1) and line(4) intersect, point(33) at which line(2) and line(4) intersect, point(34) at which line(2) and line(5) intersect, point(35) at which line(3) and line(5) intersect, point(36) at which line(3) and line(6) intersect, point(51) at which line (41) and line(46) intersect, point(52) at which line(41) and line(42) intersect, point(53) at which line(42) and line(43) intersect, point(54) at which line(43) and line(44) intersect, point(55) at which line(44) and line(45) intersect, point(56) at which line(45) and line(46) intersect, points(63,66) at which line(l), line(5), line(41), line(44) and line(9) intersect, points(61,64) at which line(3), line(4), line(42), line(45) and line(7) intersect, and points(62,65) at which line(2), line(6), line(43), line(46) and line(8) intersect, as shown in FIG. 1, FIG. 2, FIG. 5 and FIG. 6.

As for the spherical polygons formed in northern hemisphere and southern hemisphere, the spherical hexagon is made by the lines connecting points(51, 52, 53, 54, 55, 56) at equal distances to each other, with a pole (50) as a center, as to the spherical polygons which are in contact with each side of the said spherical hexagon, the 1st spherical pentagon is made by the lines connecting points(11, 31, 36, 51, 56) as like as the figures, in the same way, the 2nd spherical pentagon of points(14, 31, 32, 51, 52), the 3rd spherical pentagon of points(12, 32, 33, 52, 53), the 4th spherical pentagon of points(15, 33, 34, 53, 54), the 5th spherical pentagon of points(13, 34, 35, 54, 55), and the 6th spherical pentagon of points(16, 35, 36, 55, 56).

Additionally, as to the spherical polygons which are in contact with the aforesaid spherical pentagons at equator, the 1st spherical rhombus with two long and equal sides is made by points(11, 31, 14, 61), the 2nd spherical rhombus of points(14, 32, 12, 62), the 3rd spherical rhombus of points (12, 33, 15, 63), the 4th spherical rhombus of points(15, 34, 13, 64), the 5th spherical rhombus of points(13, 35, 16, 65), and the 6th spherical rhombus of points(16, 36, 11, 66). Each one of apices of these spherical rhombuses are arranged on the line of equator(68).

Meanwhile, as to the spherical polygons which are in contact with the said spherical rhombuses at equator, the 1st spherical triangle having two sides in equal length is made by points(14, 61, 62), the 2nd spherical triangle of points(12, 62, 63), the 3rd spherical triangle of points(15, 63, 64), the 4th spherical triangle of points(13, 64, 65), the 5th spherical triangle of points(16, 65, 66), and the 6th spherical triangle of points(11, 66, 61).

Figure 5:
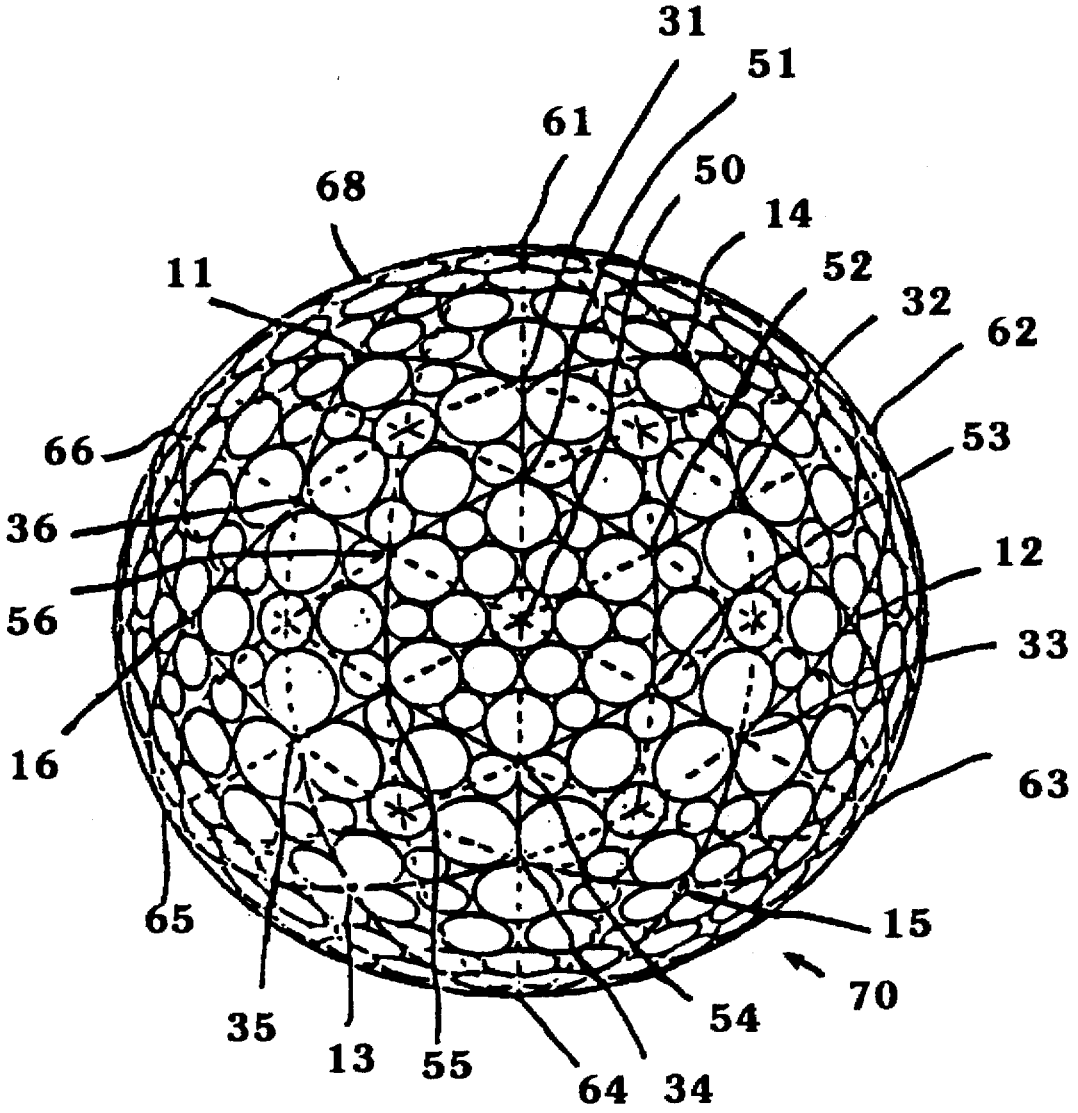
FIG. 5 is a polar view of an example according to the divisional composition of the present invention, that shows, dimples are arranged only in each spherical polygons so that no dimples intersect the sides of the polygons of the spherical surface of golf ball.
Figure 6:
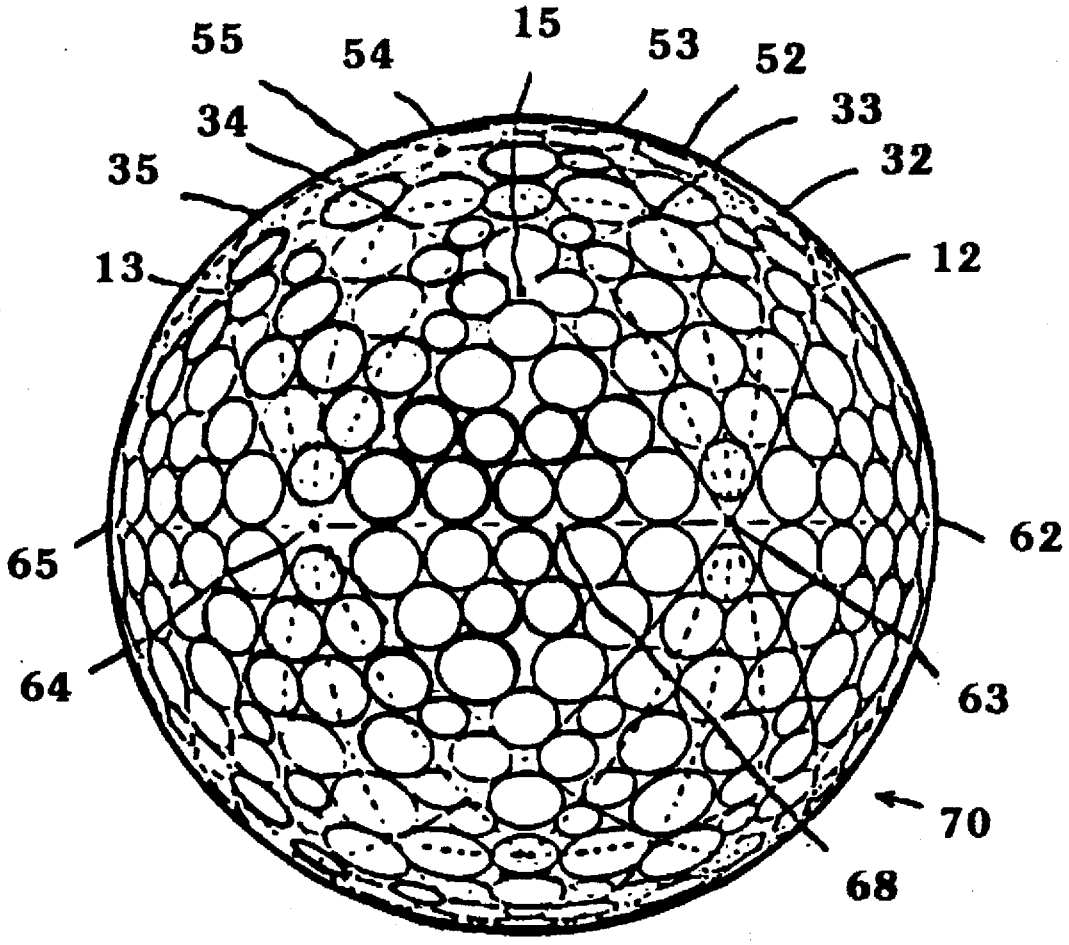
FIG. 6 is an equatorial view of the dimple arrangement of FIG. 5.
Figure 7:
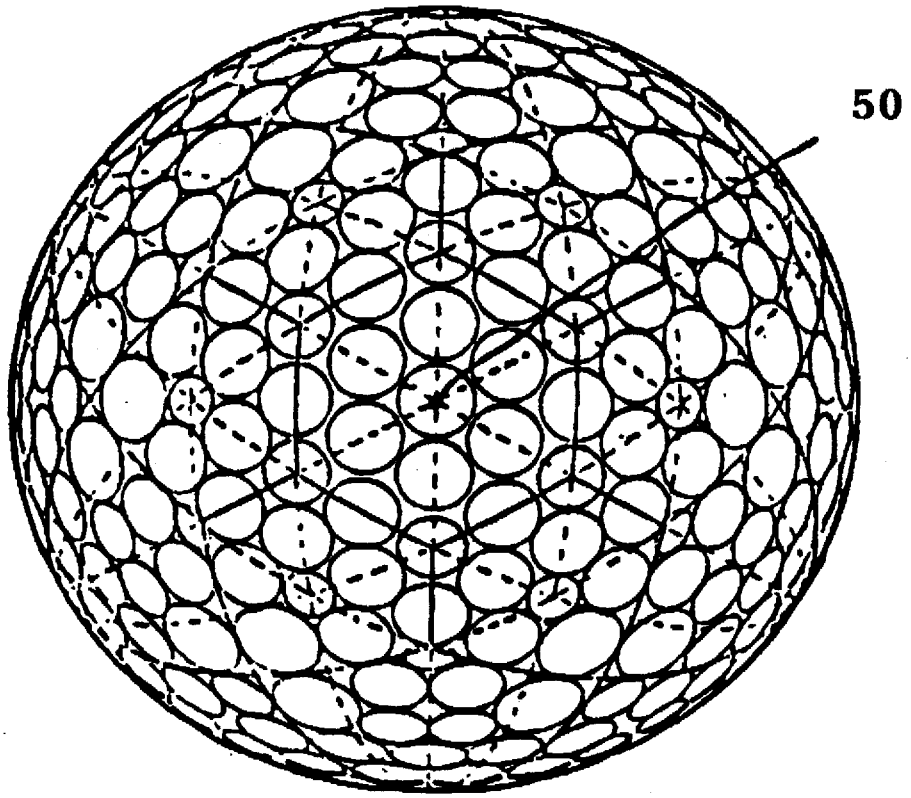
FIG. 7 is a polar view of an example according to the divisional composition of the present invention, that shows, some dimples adjacent to the sides of the spherical polygons intersect the sides of the spherical polygons over the boundary except the equator of the spherical surface of golf ball.
Figure 8:
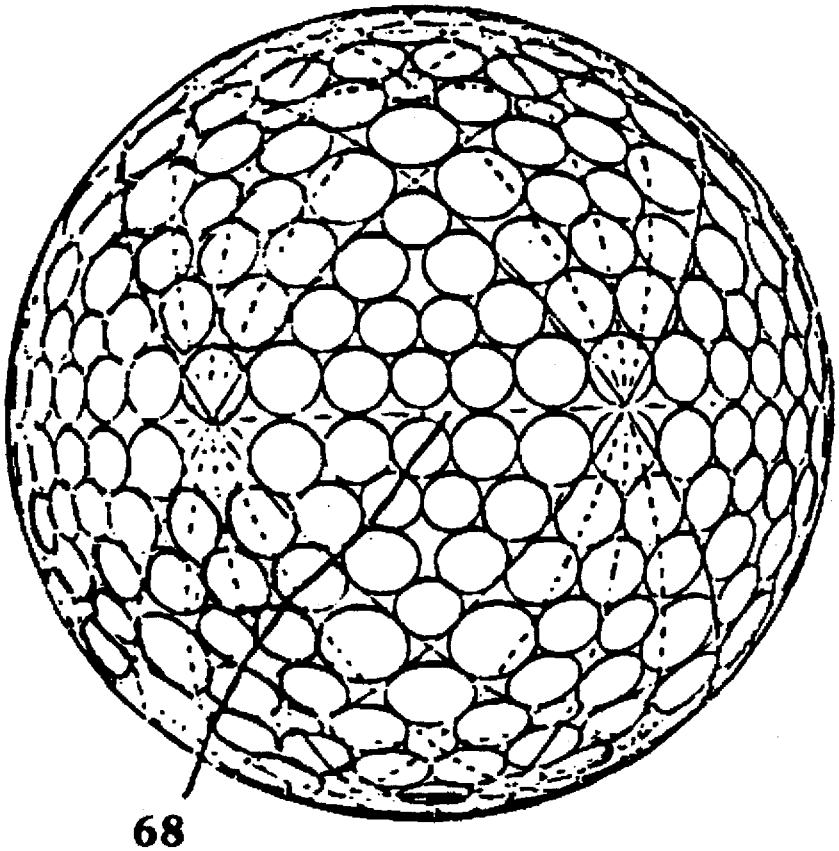
FIG. 8 is an equatorial view of the dimple arrangement of FIG. 7.

Each spherical polygon made as above is in symmetry in identical form to bi-hemisphere with equator as center. Consequently, dimples, which is arranged on the spheric surface of golf ball(70) divided by the spherical polygons made as above, can be arranged just inside bounds of each spherical polygon as shown in FIG. 5 and FIG. 6 and also can get out of bounds of each spherical polygon to lie on the bounds thereof. Accordingly, the arrangement of dimples on golf ball according to the present invention that both northern hemisphere and southern hemisphere are arranged in symmetry vertically to the line of equator is much more effective in improving the golf ball's flight distance while maintaining its aerodynamic stability as compared with that of dimples on the existing common golf balls which dimples are symmetrically arranged on the equator line in sloping by some 30° or 45°.

What is claimed is:

1. A golf ball having a spherical surface with a plurality of dimples, the dimples being arranged by dividing the spherical surface of the golf ball by great circles to form an octahedron, making the center of a spherical triangle in the said octahedron as a pole, dividing again the said sphere's surface by great circles to form a new octahedron at the position turning on the said pole as a center in an angle of 60 degrees, dividing again the said sphere's surface by great circles made by extending the lines connecting the adjacent midpoints of the sides of spherical triangle with a pole to one another, and dividing again the said sphere's surface by great circles made by extending the lines connecting the adjacent midpoints of the sides of spherical triangle at the position turning on the said pole as a center in an angle of 60 degrees to one another, and arranging dimples in the spherical polygons formed in dividing the said sphere's surface by great circles made by extending the lines connecting the midpoints of apices on spherical triangle with a pole as a center and the apices of spherical triangle at the position turning in an angle of 60 degrees to the pole.

2. The golf ball of claim 1, wherein the spherical polygons are composed of 2 spherical hexagons, 12 spherical pentagons, 12 spherical rhombuses and 12 spherical triangles.

3. The golf ball of claim 1, wherein the identical spherical polygons of each hemi-sphere are in vertical symmetry with equator as a center by themselves.

4. The golf ball of claim 1, wherein the dimples are arranged just inside bounds of each spherical polygon.

5. The golf ball of claim 1, wherein some dimples adjacent to the sides of the spherical polygons intersect the sides of the spherical polygons over the boundary except the equator of the spherical surface.

6. The golf ball of claim 1, wherein the dimples arranged on the spherical polygons are identical in size or form.

7. The golf ball of claim 1, wherein the dimples arranged on the spherical polygons are different in size or form.

8. The golf ball of claim 7, wherein the dimples arranged on the spherical polygons are identical in depth.

9. The golf ball of claim 7, wherein the dimples arranged on the spherical polygons are different in depth.

10. The golf ball of claim 1, wherein the dimples arranged on the spherical polygons are identical in depth.

11. The golf ball of claim 1, wherein the dimples arranged on the spherical polygons are different in depth.

* * * * *